United States Patent [19]

Conery et al.

[11] 4,001,533

[45] Jan. 4, 1977

[54] SEALED LEVEL CONTROL SWITCH FOR SUMP PUMPS

[75] Inventors: William James Conery; Donald D. Smith, both of Ashland, Ohio

[73] Assignees: Robert M. Keener, Ashland; McNeil Corporation, Akron; George T. Buskirk, Hayesville, all of Ohio

[22] Filed: Jan. 20, 1975

[21] Appl. No.: 542,228

[52] U.S. Cl. ..... 200/84 C; 73/308

[51] Int. Cl.[2] ..... H01H 35/18

[58] Field of Search ..... 200/84 C, 84 R; 73/308, 73/313; 340/244 A

[56] References Cited

UNITED STATES PATENTS

| | | | |
|---|---|---|---|
| 2,576,561 | 11/1951 | Binford | 200/84 C |
| 2,887,546 | 5/1959 | Hatfield et al. | 200/81.9 M |
| 3,504,316 | 3/1970 | Bekedam | 200/84 C |

FOREIGN PATENTS OR APPLICATIONS

| | | | |
|---|---|---|---|
| 640,296 | 5/1962 | Italy | 73/308 |

*Primary Examiner*—David Smith, Jr.
*Attorney, Agent, or Firm*—Oldham & Oldham Co.

[57] ABSTRACT

The control for electric sump pumps is operated by a pair of weights operatively attached to the control which has a sealed non-magnetic material housing having a downwardly open recess extending thereinto from its lower surface. A normally open microswitch having a spring control arm extending therefrom and movable downwardly to close the switch, while a permanent magnet is positioned on the arm directly above the recess, and a magnetic metal means is slidably positioned in the recess and operatively connects to the weights. The magnetic metal means attracts the permanent magnet when the metal means is at the upper portion of the recess and this closes the switch arm with the position of the metal means in the housing in relation to the magnet being controlled dependent upon the water level in the sump.

4 Claims, 2 Drawing Figures

SEALED LEVEL CONTROL SWITCH FOR SUMP PUMPS

BACKGROUND OF INVENTION

In many sumps as made and used today, pumps are provided for pumping the contents of the sump therefrom. Heretofore, it has been well known to provide different types of controls for automatic operation of the sump pump dependent upon the level of the water in the sump. These controls have been float actuated switches and other means to close the control and actuate the pump when the water level in the sump reaches a predetermined level and shuts off the pump when the water level is reduced to a desired minimum.

In the production of sump pumps and controls, costs are important so that the provision of an inexpensive, low cost control switch which is positive in operation and dependable to provide a long service life with no maintenance thereon, is needed in the art.

The general object of the present invention is to provide a novel control for electric sump pumps wherein the control is characterized by the provision of a permanent magnet positioned on the arm of a microswitch and which arm is movable downwardly to close the switch, and by a magnetic metal member slidably associated with the magnet in the control and having its position determined by the water level in the sump.

Another object of the invention is to provide a sealed control housing for a control switch for a sump pump and wherein the control operates by magnetic attraction of a movable member positioned in the control and adjustable in position in relation to a magnet associated with the control arm of the switch.

Yet another object of the invention is to provide a control for a sump pump which is operated by a magnetic attraction between a vertically spaced magnetic metal member and a permanent magnet member and with the position of one of such members being dependent upon the water level in the sump, such member being operatively connected to a pair of spaced displacement weights suspended from the control member by a non-magnetic support cable.

Another object of the invention is to provide a permanent magnet mounted directly on the control arm of a control switch positioned in a sealed plastic housing for a control for a sump pump and to utilize such permanent magnet for switch opening and closing action in association with water level indicators movable in relation to the magnet.

The foregoing and other objects and advantages of the invention will be made more apparent as the specification proceeds.

Figure 1:
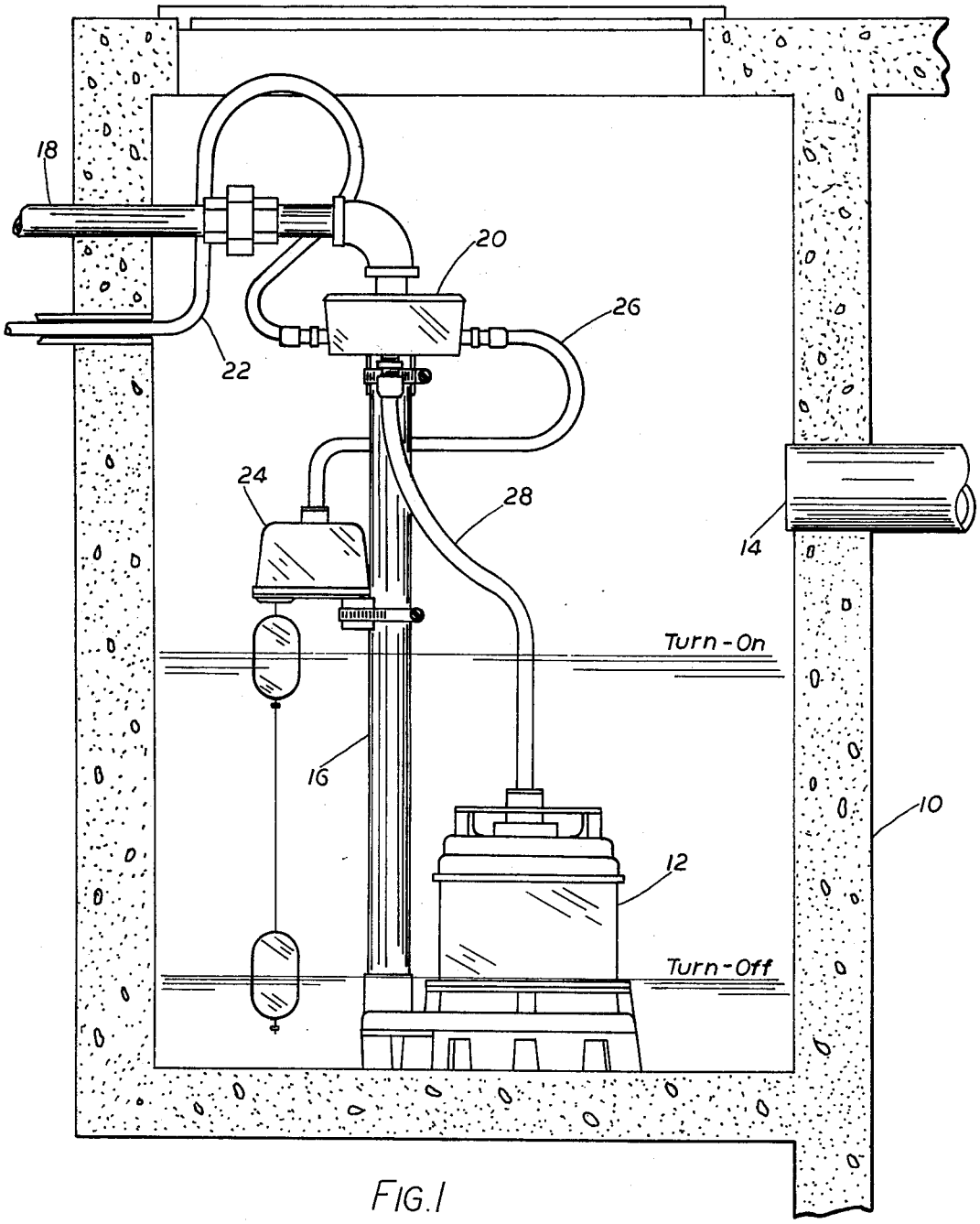
Figure 2:
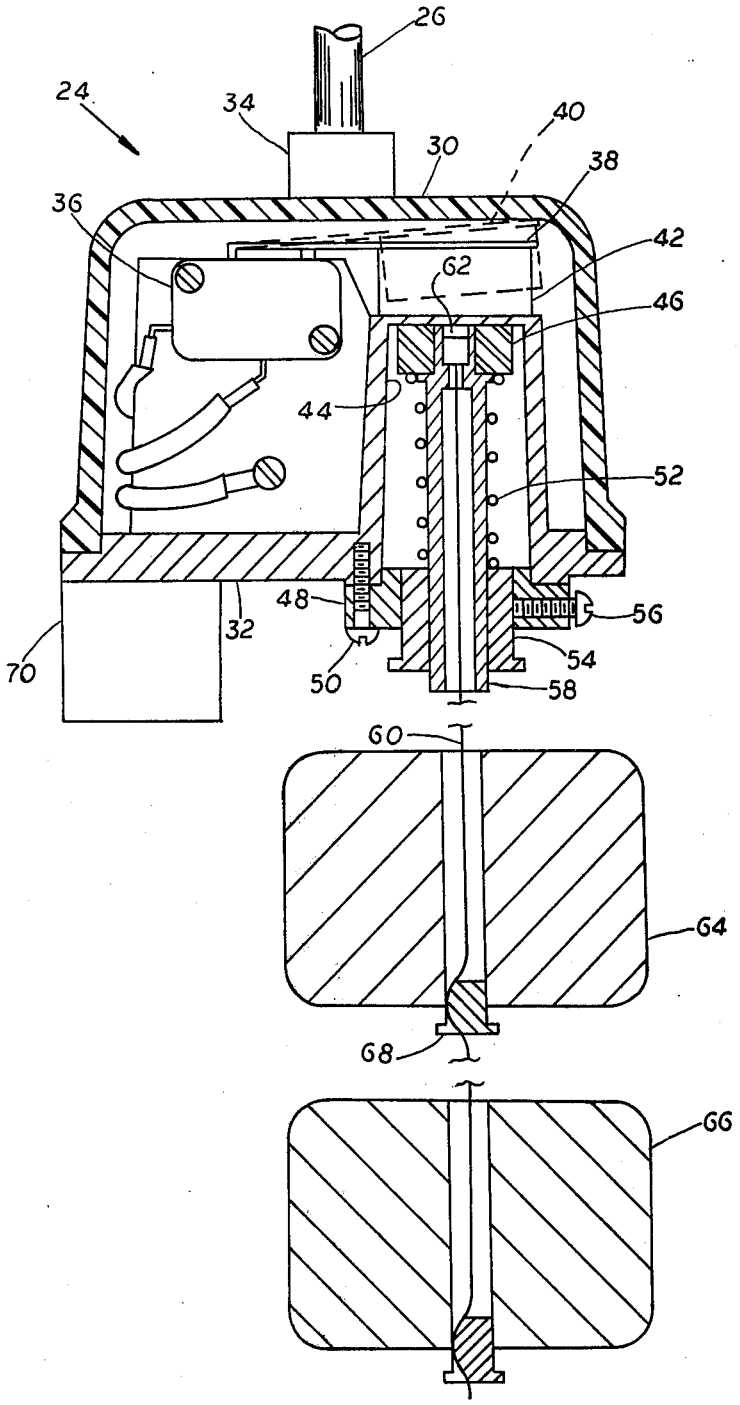

Reference now is made to the accompanying drawings, wherein:

FIG. 1 is a vertical section, partially shown in elevation, of a sump and an associated sump pump and control apparatus embodying the principles of the invention; and FIG. 2 is an enlarged vertical section through the control switch and associated means of the invention.

When referring to corresponding members shown in the drawings and referred to in the specification, corresponding numerals are used to facilitate comparison therebetween.

SUBJECT MATTER OF THE INVENTION

The invention, as one embodiment thereof, relates to a control for an electric sump pump and which control is operated by a pair of displacement weights operatively attached to a control means and including a sealed non-magnetic material housing having a downwardly open recess extending thereinto from its lower surface, a normally open microswitch having a spring control arm extending therefrom and movable downwardly to close such switch, a permanent magnet secured to such arm and positioned above such recess, and a magnetic metal means slidably positioned in the recess and operatively connecting to the displacement weights to vary the position vertically of the metal means in the housing in relation to the magnet to control switch action dependent upon the water level in the sump and the control action of the weights that are secured to and depend from the metallic means, and a spring means operatively engages the magnetic metal means and urges it upwardly of the housing against the action of the weights connected thereto.

The accompanying drawings show a typical sump 10 that has an electrical pump 12 positioned at the bottom thereof. This sump has an inlet 14 and an outlet pipe 16 connected to the pump 12 and extending up to an outlet pipe 18 extending from the sump.

The apparatus may also include a waterproof connection box 20 having a power lead 22 connecting thereto and extending from the sump. The actuation and operation of the pump 12 is obtained by means of a control 24 which connects by leads 26 to the connection box 20 and from which a power supply lead 28 connects to the pump whereby operation of the pump is controlled through the action of the control means 24. The apparatus in FIG. 1 is not necessarily to operative scale.

The details of the control of the invention are best shown in FIG. 2, and such control comprises a sealed level control switch for the sump pump and adapted to be turned on automatically when the water in the sump reaches the turn on level as indicated and to be turned off when the water level is reduced, as indicated.

The control 24 comprises a non-magnetic housing as one made from plastic, having a housing cap or bell 30 and a bottom plate 32 suitably secured to the open mouth or lower end of the cap 30 for fixed, permanent sealed engagement therewith. The power cord 26 extends through the housing cap 30 by sealed connecting means 34. The power leads connect to a microswitch 36, normally open, and which switch has a spring contact or control arm 38 extending therefrom. This control arm 38 is movable in a vertical plane and its operative position is indicated wherein it closes the contacts for the switch 36 to make it conductive, whereas when this arm 38 is in its released position as indicated at 40, then the microswitch arm releases the switch for its normal circuit interrupting condition.

As an important feature of the invention, the spring arm 38 has a permanent magnet 42 suitably secured to and depending from the lower surface of the arm. Such permanent magnet 42 is positioned, normally, directly above a upwardly extending recess 44 formed in the base 32 and downwardly open in the control 24. A magnetic metal means, usually a magnetic stainless steel disc or actuator 46 is positioned in this recess 44 so as to be slidable vertically thereof. Preferably the bottom opening of the recess 44 is closed as by a cover 48 secured to the base 32 as by cap screws 50. A stainless steel spring 52, non-magnetic, is compressed between the metal disc 46 and the cover 48 or else by a bushing 54 axially adjustably positioned in a hole in the cover 48 and retained in a given position by a set screw 56. Thus, by adjusting the axial position of the bushing 54, the compression action or tension in the spring 52 can be adjusted. Preferably, the magnetic stainless steel actuator 46 has a tubular plastic actuator stem 58 secured thereto and extending downwardly therefrom and being slidable in the bushing 54. This stem 58 normally is positioned on the axis of the spring 52 which encompasses the stem and is partially retained in operative position thereby.

Control of the position of the actuator 46 is provided by means of a stainless steel support cable 60 that is suitably secured to the actuator 46 as by a member 62 to extend from the control 24 and support a pair of displacement weights 64 and 66 in vertically spaced relationship to the control. Lock members 68 releasably engage center bores in these weights to fix the cable 60 thereto and position these weights in desired vertically spaced relationship.

In operation, the control 24 is shown with the switch 36 in closed position and this would be when the sump level was up. When the sump level drops, the top displacement weight 64 comes out of the water and adds tension to the cable 60 and the spring 52 due to the greater weight supported because the displacement weight 64 is out of water. As the level continues to drop, the lower weight 66 starts to come out of the water and adds additional tension or weight to the spring. Preferably the relationship of the permanent magnet 42, in its strength, the resilient action of the spring 38, the control action by the stainless steel spring 52 and the mass of the metal actuator 46 are so correlated that when the actuator 46 has been pulled downwardly a desired distance, the permanent magnet 42 is released and the switch is turned off by the control arm 38.

In reverse action, when the water level rises in the sump, this causes the tension of or weight on the spring 52 to be reduced and the metal actuator or follower 46 rises and ultimately attracts the magnet causing the arm 38 to close the switch and again start the pump action.

In some instances, it may be desirable to place a metallic block on the spring 38 in place of the permanent magnet and to have the permanent magnet be used in place of the magnetic stainless steel actuator or follower 46 as shown, but yet the same control action can be obtained.

A bracket 70 usually is provided on the base 32 of the housing by which such control 24 can be mounted as for instance on the outlet pipe 16 positioned in the sump.

The control 24 has no magnetic members but for the magnet 42 and actuator 46.

The apparatus of the invention is relatively simple to assemble and is low in cost, but yet positive and dependable in operation.

The control of the invention does not need to be opened in service and will remain sealed and watertight for a long service life.

In view of the foregoing, it is believed that the objects of the invention have been achieved and that a novel and improved control for an electric sump pump has been obtained.

While one complete embodiment of the invention has been disclosed herein, it will be appreciated that modification of this particular embodiment of the invention may be resorted to without departing from the scope of the invention.

What is claimed is:

1. In a control for an electrically powered sump pump, a sealed non-magnetic material housing having power leads connected to the interior thereof and being adapted to be positioned within a sump at an upper portion thereof, said housing having a downwardly open cup-shaped section and a base section extending across the open end of said cup-shaped section, and characterized by a normally open microswitch connected to said power leads to control current flow, said microswitch having a spring control arm extending therefrom for movement in a vertical plane and for closing said switch when said control arm is moved toward said switch, said housing having a downwardly facing tubular recess formed therein directly vertically below said control arm, said housing base section having a wall portion extending vertically upwardly to form said recess which is open at its lower end and closed at its upper end, a pair of cooperating permanent magnet and magnetic members the first of which is secured to said control arm and the second of which is positioned in said recess for controlled vertical movement therein, said magnet and magnetic members being positioned in adjacent but spaced vertical relation, a non-magnetic coil spring engaging the second of said members to urge it toward the upper end of said recess, a non-magnetic cable attached to said second member, and displacement weight means attached to spaced portions of said cable to pull said second member downwardly and release the switch arm to open said switch under low water conditions and enable said switch to be closed under high water conditions that permit said second member to move to a point adjacent the upper end of said recess and have attraction between said members pull said control are downwardly.

2. In a control as in claim 1, a non-magnetic tubular member extending axially of and within said coil spring to position it for axial compression and adjustment means on said housing operatively engaging one end of said coil spring to adjust its position and to control the lifting forces therein.

3. In a control for an electrically powered sump pump, a sealed non-magnetic material housing having power leads connected to the interior thereof and being adapted to be positioned within a sump at an upper portion thereof, said housing having a downwardly open cup-shaped section and a base section extending across the open end of said cup-shaped section, and with the control including a normally open microswitch connected to said power leads to control current flow, said microswitch having a spring control arm extending therefrom for movement in a vertical plane and for closing said switch when said control arm is moved toward said switch, a permanent magnet secured to said control arm, said housing having a downwardly facing recess formed therein below said permanent magnet, said housing base section having a wall portion extending vertically upwardly to form said recess which is open at its lower end, a magnetic metal disc positioned in said recess for controlled vertical movement therein, said magnet and metal disc being positioned in adjacent but spaced vertical relation, a non-magnetic coil spring urging said disc toward the upper end of said recess, a non-magnetic cable attached to said metal disc; displacement weight means attached to spaced portions of said cable to pull said metal disc downwardly and open said switch under low water conditions and enable said switch to be closed under high water conditions that permit said metal disc to move to a point adjacent the upper end of said recess and attract said magnet to pull said control arm downwardly to close said microswitch; and adjustment means on said housing and engaging one end of said coil spring means to adjust its position to control the lifting forces exerted on said metal disc, said coil spring being axially compressed between said metal disc and said adjustment means.

4. A control as in claim 3, where said adjustment means include a collar attached to said housing at the lower end of said recess, a vertically positioned sleeve slidably engaging said collar and having an upper end engaging said coil spring, and set screw means engaging said collar and sleeve to retain said sleeve in a given position.

* * * * *